US007670445B2

(12) United States Patent
Gejima et al.

(10) Patent No.: US 7,670,445 B2
(45) Date of Patent: Mar. 2, 2010

(54) TITANIUM ALLOY OF LOW YOUNG'S MODULUS

(75) Inventors: Fumihiko Gejima, Yokohama (JP); Takuro Yamaguchi, Yokohama (JP); Shuji Hanada, Sendai (JP); Hiroaki Matsumoto, Sendai (JP); Sadao Watanabe, Miyagi (JP)

(73) Assignees: Nissan Motor Co., Ltd., Yokohama-shi (JP); Tohoku University, Sendai-shi (JP)

( * ) Notice: Subject to any disclaimer, the term of this patent is extended or adjusted under 35 U.S.C. 154(b) by 161 days.

(21) Appl. No.: 11/653,955

(22) Filed: Jan. 17, 2007

(65) Prior Publication Data

US 2007/0163681 A1 Jul. 19, 2007

Related U.S. Application Data

(60) Provisional application No. 60/847,086, filed on Sep. 26, 2006.

(30) Foreign Application Priority Data

Jan. 18, 2006 (JP) ..... P2006-009902
Aug. 23, 2006 (JP) ..... P2006-226380

(51) Int. Cl.
*C22C 14/00* (2006.01)
*C22C 21/06* (2006.01)

(52) U.S. Cl. ..... 148/421; 148/417; 420/420

(58) Field of Classification Search ..... None
See application file for complete search history.

(56) References Cited

U.S. PATENT DOCUMENTS 4,412,872 A * 11/1983 Albrecht et al. ..... 148/501
6,607,693 B1 8/2003 Saito et al.

FOREIGN PATENT DOCUMENTS

JP 03079736 * 5/1991
JP 2002-180168 A 6/2002
JP 3375083 B2 2/2003
JP 2004-353039 A 12/2004
JP 2005-113227 A 4/2005

* cited by examiner

*Primary Examiner*—Melvin C Mayes
*Assistant Examiner*—Sarah Van Oudenaren
(74) *Attorney, Agent, or Firm*—Foley & Lardner LLP

(57) ABSTRACT

A titanium alloy contains vanadium, from 10 to 20% by weight; aluminum, from 0.2 to 10% by weight; and a balance essentially titanium, and the alloy has a microstructure including a martensite phase. Alternatively, the titanium alloy contains vanadium, from 10 to 20% by weight; aluminum, from 0.2 to 10% by weight; and a balance essentially titanium, and the alloy has a microstructure including a β phase capable of transforming into a martensite phase by cold working or cooling under a room temperature.

7 Claims, 9 Drawing Sheets

SINGLE-PHASE OF $\beta$

TITANIUM ALLOY OF LOW YOUNG'S MODULUS

CROSS-REFERENCE TO RELATED APPLICATIONS

This application is based upon and claims the benefit of priority from the U.S. Provisional Application No. 60/847,086 (filed Sep. 26, 2006) and the prior Japanese Patent Applications No. 2006-009902 (filed Jan. 18, 2006) and No. 2006-226380 (filed Aug. 23, 2006); the entire contents of which are incorporated herein by reference.

BACKGROUND OF THE INVENTION

1. Field of the Invention

The present invention relates to a titanium alloy of low Young's modulus, which provides high strength, low elasticity modulus, and high elastic deformability.

2. Description of the Related Art

As having advantages of specific strength and corrosion resistance, titanium alloys are in general use for various specific fields of arts, such as aviation, defence, aerospace, deep-water exploration, and chemical industry.

Microstructures of titanium alloys may have polymorphism dependent on both temperature and chemical composition. An α phase and a β phase are representatives of thermodynamically stable phases composing microstructures of titanium alloys, and are respectively correspondent to a stable phase at the room temperature and a high-temperature phase of pure titanium. A temperature at which transformation between the α phase and the β phase occurs is referred to as a beta transus temperature. Some additive elements such as vanadium lower the beta transus temperature. Upon adding proper amounts of such elements, the beta transus temperature may be lowered close to or even under the room temperature, and therefore some titanium alloys has microstructures including a β phase at the room temperature. More specifically, some titanium alloys could be classified into an α type, an α+β type, and a β type, based on phases included in these microstructures.

As well as the above thermodynamically stable phases of the α phase and the β phase, martensite phases may also appear in titanium alloys. Martensite is a general name for any distorted microstructures resulted from transformation without atomic diffusion, and, in a case of titanium alloys, may typically appear when any of the titanium alloys is quenched from temperatures over the beta transus temperature.

A Ti-6% Al-4% V alloy classified as the α+β type is widely used for the reason of its high strength. As β type titanium alloys used hitherto, Ti-15V-3Cr-3Sn-3Al and Ti-22V-4Al alloys are known and applied to spectacle frames, golf clubs and such, as having flexibility.

Regarding Young's moduli of the titanium alloys used hitherto, it should be noted that those of the α type alloys are on the order of 115 GPa, those of the α+β type alloys such as the Ti-6Al-4V alloy are on the order of 110 GPa, and those of the β type alloys are on the order of 80 GPa after solution treatments, and on the order of 110 GPa after aging treatments.

SUMMARY OF THE INVENTION

High specific strength of titanium alloys is attractive in the sense of engineering, while relatively high Young's modulus may be often problematic for some applications that require flexibility. In this view, the present inventors had diligently studied means for reducing Young's modulus without deteriorating high specific strength of titanium alloys.

As a result, the present inventors had found out that controlled inclusion of martensite phases such as an α' phase and an α" phase meets this object and further invented means for controlling the martensite phases in the titanium alloys. The present invention had been reached upon such knowledge.

According to a first aspect of the present invention, a titanium alloy contains vanadium, from 10 to 20% by weight; aluminum, from 0.2 to 10% by weight; and a balance essentially titanium, and the alloy has a microstructure including a martensite phase.

According to a second aspect of the present invention, a titanium alloy contains vanadium, from 10 to 20% by weight; aluminum, from 0.2 to 10% by weight; and a balance essentially titanium, and the alloy has a microstructure including a β phase capable of transforming into a martensite phase by cold working or cooling under a room temperature.

Preferably, the titanium alloy further contains one or more elements selected from the group of stannum, silicon and indium, the elements being from 0.01 to 10% by weight. More preferably, the titanium alloy is treated with a solution treatment at a β transus temperature or higher and cold working after the solution treatment. Still preferably, the alloy is worked to plastically deform in a specific direction, the martensite phase includes an α' phase and an α" phase, and diffraction intensities of the alloy by a X-ray diffraction method satisfies any one or more inequalities selected from the group of, $(I\alpha''(002)_{\perp}/I\alpha'(111)_{\perp})/(I\alpha''(002)_{\parallel}/I\alpha''(111)_{\parallel}) \leqq 1$, and $(I\alpha'(002)_{\perp}/I\alpha'(101)_{\perp})/(I\alpha'(002)_{\parallel}/I\alpha'(101)_{\parallel}) \leqq 1$, where $I\alpha''(002)_{\perp}$ represents a diffraction intensity from a (002) face of the α" phase in a section perpendicular to the specific direction, $I\alpha''(111)_{\perp}$ represents a diffraction intensity from a (111) face of the α' phase in a section perpendicular to the specific direction, $I\alpha''(002)_{\parallel}$ represents a diffraction intensity from a (002) face of the α" phase in a section parallel to the specific direction, $I\alpha''(111)_{\parallel}$ represents a diffraction intensity from a (111) face of the α" phase in a section parallel to the specific direction, $I\alpha'(002)_{\perp}$ represents a diffraction intensity from a (002) face of the α' phase in a section perpendicular to the specific direction, $I\alpha'(101)_{\perp}$ represents a diffraction intensity from a (101) face of the α' phase in a section perpendicular to the specific direction, $I\alpha'(002)_{\parallel}$ represents a diffraction intensity from a (002) face of the α' phase in a section parallel to the specific direction, and $I\alpha'(101_{\parallel}$ represents a diffraction intensity from a (101) face of the α' phase in a section parallel to the specific direction.

DETAILED DESCRIPTION OF THE PREFERRED EMBODIMENT

Figure 1:
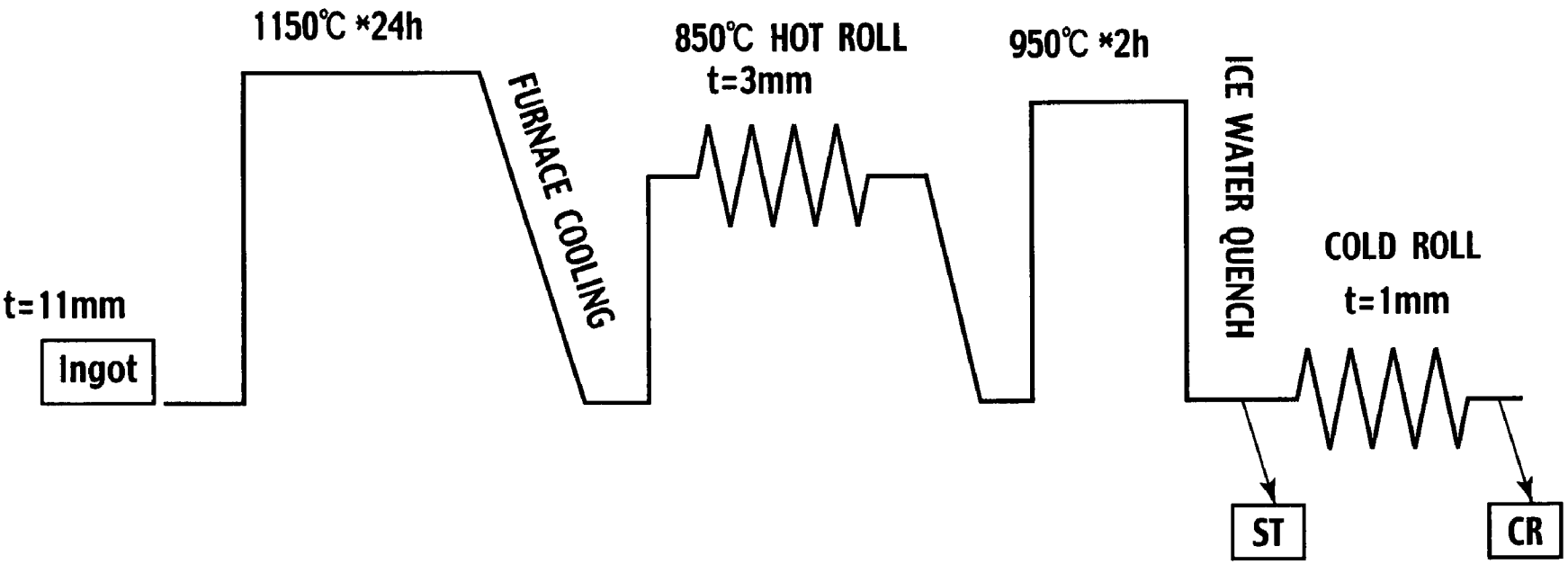
[FIG. 1] is a process chart showing a treatment treated for working examples and comparative examples.

A further detailed description of a titanium alloy according to the present invention will be given hereinafter. Meanwhile, throughout the present specification, "%" represents a mass percentage unless any particular explanation is given.

It is found that any titanium alloy having a small content of V and a martensite phase at the room temperature has a low Young's modulus. Further, it is found that crystal orientations (textures) can be aligned by proper plastic deformation such as rolling because a particular martensite variant grows. Because the martensite phase per se has anisotropy with respect to the Young's modulus, control of alignment of the crystal orientations provides the titanium alloy with controlled anisotropy with respect to the Young's modulus. In other words, if one requires a lower Young's modulus in a specific direction of the alloy, controlled anisotropy provides means for meeting such a requirement. Further, it is found that, because strengthening by work hardening occurs simultaneously, the alloy can have a high strength in combination with a low Young's modulus.

Further, while the β phase of the titanium alloys is known to have a low Young's modulus, the present inventors have found out that, if contents of vanadium and aluminum in the Ti—V—Al alloys are regulated, the β phase kept at the room temperature may undergo martensite transformation induced by applied stress or cooling and then become thermodynamically unstable, and that the β phase at a stage prior to such martensite transformation is further reduced in the Young's modulus.

With the aforementioned knowledge, embodiments of the present invention will be described hereinafter.

A first titanium alloy of a low Young's modulus of the present invention contains 10-20% vanadium (V), 0.2-10% aluminum (Al), and the balance composed of titanium (Ti) and unavoidable impurities. Further, the alloy is formed of at least a martensite phase in its component phases after a solution treament.

A second titanium alloy of a low Young's modulus of the present invention contains 10-20% V, 0.2-10% Al, and the balance composed of Ti and unavoidable impurities. Further, the alloy is formed of a β phase in its component phases, and the β phase carries out martensite transformation by cold plastic working or cooling from the room temperature.

Here, the component phases of the Ti—V—Al alloys will be described.

The α" phase and the α' phase reduce the Young's modulus. If variants of the α" phase and the α' phase are properly regulated, it can lead to reduction in the Young's modulus particularly in a specific direction. For example, after a solution treatment at a beta transus temperature or higher, if cold rolling or cold plastic working such as drawing is carried out, the Young's modulus in its working direction (a direction of rolling or drawing) can be reduced. In this occasion, though a degree of working is not limited, in a case of cold rolling, at least draft ratios of 40% or more are preferable for obtaining sufficient crystal orientation in view of reduction in the Young's modulus.

Moreover, the β phase at a leading stage prior to such martensite transformation is thermodynamically unstable and reduces the Young's modulus. Further, in the thermodynamically unstable β phase, an α" phase comes out as induced by working of cold working, and reduction in the Young's modulus in the working direction is enabled. However, a stable β phase which is insusceptible to transformation into an α" phase does not well reduce the Young's modulus.

As well as the aforementioned β, α' and α" phases, in the titanium alloy of a low Young's modulus of the present invention, strengthening by using aging hardening can be applied because an α phase precipitates by low temperature aging about 400 degrees C. for example after a solution treatment. However, the α phase simultaneously increases the Young's modulus, therefore, in view of reduction in the Young's modulus, the α phase should be avoided. Thereby, existence of a small amount of the α phase leads to maintaining both a high strength and a low Young's modulus. For example, the α phase may be contained in about 5 vol % to the β, α' and α" phases.

Further, in the β type titanium alloys which carry out martensite transformation, the β phase is unstable so that a ω phase which may cause embrittlement is easy to come out, and therefore such the β type titanium alloys are tend to be avoided as high strength β type titanium alloys in practical use. However, the ω phase is suppressed in the composition range of the titanium alloy of a low Young's modulus of the present invention.

In the titanium alloy of the present invention, V is an element for lowering the beta transus temperature so as to stabilize the β phase. If the V content is too little, namely less than 10%, martensite transformation is uneasy to occur. If the V content is too much, namely more than 20%, the β phase is too stable not to transform into the martensite. Therefore, the V content is preferably 10-20% (the first aspect of the present invention). However, if stress-induced martensite transformation from the β phase is intended to be used (the second aspect of the present invention), slightly greater contents may be preferable, namely 14-20%.

Al is an element improving strength of the titanium alloy and further has an effect for suppressing the ω phase which may cause embrittlement. If the Al content is too little, such effects are insufficient. On the other hand, if the Al content is too much, ductility of the titanium alloy is reduced. Therefore the Al content is preferably 0.2-10%.

Meanwhile, reduction in the ductility gives rise to reduction in elastic deformability as a result because fracture may occur before starting plastic deformation.

Moreover, as well as V and Al, stannum (Sn), silicon (Si) and indium (In), or any arbitrary combination thereof, may be contained in the titanium alloy of the present invention.

Sn and In are both solid solution strengthening elements, suppressing the ω phase, and effective in improvement of workability of the titanium alloy. However, too much addition may give rise to embrittlement. Therefore the Sn or In content is preferably 10% or less.

Si is a solid solution strengthening element, suppressing the ω phase, and effective in reduction in the Young's modulus of the titanium alloy. However, too much addition may give rise to embrittlement. Therefore the Si content is preferably 10% or less.

More specifically, the content of any of Sn, In and Si is preferably 0.01-10% to the total of the titanium alloy. In this case, a favorable strength-ductility balance may be reached.

The balance of the titanium alloy in accordance of the embodiments of the present invention consists essentially of titanium, whereas any unavoidable impurities or any elements which do not materially affect the basic and novel characteristics of the alloy may be also present in the alloy. The Ti content is preferable to be 50 atomic % or more to the total of the titanium alloy, unless the density becomes greater and therefore the specific strength becomes lower.

Further, the titanium alloy according to the embodiments of the present invention is preferably produced by carrying out a solution treatment at a beta transus temperature or higher and cold plastic working after the solution treatment.

If the solution treatment at the beta transus temperature or higher is carried out, a volume fraction of the α" phase and the α' phase, both of which provide low elasticity, is increased, and, as well, workability is improved because a volume fraction of the α phase is made smaller. Further, if cold working after this is carried out, a strength is increased by means of working hardening, and, as well, elasticity does not rise as compared with a state prior to the working.

Further, the titanium alloy according to the embodiments of the present invention is preferably produced by worked into a wire rod or a longitudinal strip, and including a martensite phase composed of at least an α' phase and an α" phase, in that diffraction intensities thereof by a X-ray diffraction method satisfying any one relation represented by the following equations (1) and (2) of $(I\alpha''(002)_{\perp}/I\alpha''(111)_{\perp})/(I\alpha''(002)_{\parallel}/I\alpha''(111)_{\parallel})\leqq 1$—(1), and $(I\alpha'(002)_{\perp}/I\alpha'(101)_{\perp})/(I\alpha'(002)_{\parallel}/I\alpha'(101)_{\parallel})\leqq 1$—(2) (Here, in any of equations, $I\alpha''(002)_{\perp}$ represents a diffraction intensity from a (002) face of the α" phase in a section perpendicular to the longitudinal direction, $I\alpha''(111)_{\perp}$ represents a diffraction intensity from a (111) face of the α" phase in a section perpendicular to the longitudinal direction, $I\alpha''(002)_{\parallel}$ represents a diffraction intensity from a (002) face of the α" phase in a section parallel to the longitudinal direction, $I\alpha''(111)_{\parallel}$ represents a diffraction intensity from a (111) face of the α" phase in a section parallel to the longitudinal direction, $I\alpha'(002)_{\perp}$ represents a diffraction intensity from a (002) face of the α' phase in a section perpendicular to the longitudinal direction, $I\alpha'(101)_{\perp}$ represents a diffraction intensity from a (101) face of the α' phase in a section perpendicular to the longitudinal direction, $I\alpha'(002)_{\parallel}$ represents a diffraction intensity from a (002) face of the α' phase in a section parallel to the longitudinal direction, and $I\alpha'(101)_{\parallel}$ represents a diffraction intensity from a (101) face of the α' phase in a section parallel to the longitudinal direction.)

Then, it is effective because the alloy has further smaller elasticity in the longitudinal direction. Though the details are still under diligent study, it may be caused by that martensite variants of the α" phase and the α' phase are oriented so that the alloy is less elastic in the longitudinal direction.

Moreover, methods of working the alloy into a wire rod or a longitudinal strip are not limited but preferably cold working, thermally plastic working, and any machining such as grinding and cutting for example. Therefore, in a case where a longitudinal strip is produced by rolling, any members having arbitrary angle to the direction of rolling may be obtained by cutting out the members from the rolled strip, thereby the longitudinal direction defined for the equations (1) and (2) is not limited to the direction of rolling.

However, in a case of a strip, face intensities of a section parallel to the longitudinal direction are defined as face intensities of a surface of the strip from which a working deformation layer at an outermost surface thereof is removed.

Still further, the Young's modulus of the titanium alloy according to the embodiments of the present invention is preferably 70 GPa or less.

Here, a Young's modulus is measured according to JIS Z 2280. The Young's modulus generally has temperature dependence but one measured at the room temperature is used in the present invention.

Here, the production method of the titanium alloy according to the embodiments of the present invention is not limited but may be as follows.

For example, melting and casting are accomplished by any of a vacuum fusion method usually applied to titanium alloys, an argon arc fusion method, an electron beam fusion method and such. An obtained ingot is worked by any general method such as hot rolling, hot forging, extrusion, cold rolling, or drawing. In the process or after completion of working, heating at a β transformation point or higher for purpose of solution or homogenization, and quenching are accomplished to obtain the titanium alloy. Meanwhile, instead of the process, superplastic formation, sintering, or any variable production methods may be applied to the production.

The titanium alloy according to the embodiments of the present invention as described above involves various shapes, and not limited to a material (for example, an ingot, a slab, a billet, a sintered body, a rolled article, a forged article, a wire rod, a strip, a rod and such) but may be any article produced by working the material (for example, an intermediate product, a final product or any part thereof).

More specifically, the alloy can be widely applied to various products and can provide high strength and low elasticity for the products, improvement of productivity, and reduction in production cost.

Representatively, because the alloy contains elements in common with the widely used Ti-6% Al-4% V alloy, a recycled matter of the Ti-6% Al-4% V alloy can be applied to raw materials at a time of melting and casting, and thereby reduction in cost can be achieved. For example, the alloy can be used in automobiles, industrial machines, bikes, bicycles, precision machines, home electric appliances, aerospace machines, ships, accessories, sport and leisure goods, biomedical devices, medical devices, toys and such.

Further, the alloy can be applied to products to which vibration absorption is required. More specifically, the titanium alloy according to the embodiments of the present invention has a lower Young's modulus than the prior titanium alloys, and, while a martensite phase or a maritensite transformation is applied in the alloy, the martensite phase performs twin crystal deformations as with damping alloys of a twin crystal type such as typified by Ti—Ni and Mn—Cu, thereby products excellent in quality of vibration absorption can be obtained from the alloy as with these damping alloys.

In concrete, the titanium alloy according to the embodiments of the present invention is preferably applied to springs of automobiles, for example. In this case, because the Young's modulus is small and the elastic deformability is great, reduction in the number of turns as compared with the prior spring steels is made possible and the spring can be excellent in quality of vibration absorption is. Further, because the titanium alloy according to the embodiments of the present invention is considerably lighter than the usual spring steels, reduction in weight to a great degree can be realized. Furthermore, because the alloy is excellent in quality of vibration absorption, it can be preferably applied to absorbing buffer members for preventing hollow note in compartments of automobiles, and mounts for car audio systems for clearing fluttering sound.

Further, the alloy can be preferably applied to spectacle frames as a kind of accessories. In this case, because of the low Young's modulus, temples or such parts are easy to bend so that the spectacle frames fit faces well, and they may become excellent in impact absorbency and quality of shape recovery. Further, because the alloy has high strength and is excellent in cold workability, it is easy to form a core wire into spectacle frames and yield ratio of production can be improved.

Moreover, the alloy is preferably used in golf clubs as a kind of sports and leisure goods, in particular shafts thereof.

In this case, the shafts are easy to bend, and thereby elastic energy transmitted to a golf ball is increased so that flying distance of the golf ball may be improved. On the other hand, the alloy can be preferably applied to heads of the golf clubs, in particular face parts thereof. In this case, by the low Young's modulus and reduction in thickness led from the high strength, flying distance of a golf ball can be considerably extended.

Still further, the titanium alloy according to the embodiments of the present invention is applied to various products in various fields, such as springs for engine valves of automobiles, suspension springs, various metal seals, chassis, bolts, various torsion bars, spiral springs, transmission belts (hoops of CVT), gears, linings of tires, reinforcements of tires, various vessels such as fuel tanks, belts for fixation of devices and wires.

WORKING EXAMPLES

The present invention will be described hereinafter with reference to the following working examples and comparative examples in further detail, however, the present invention is not limited thereto.

Working Examples 1, 2, 4, 5, 7, 9, 11, 13, 15-19, 21

Titanium alloys having compositions shown in Table 1 were produced in accordance with the following procedures.

Applying pure metals of Ti, V, Al of 99.9% pure, the alloys having compositions shown in Table 1 were produced and obtained as ingots of about 90 g, by arc fusion in an argon atmosphere.

The ingots were treated with a homogenizing treatment at 1150 degrees C. for 24 hours in an argon atmosphere, and, after this, treated with hot rolling at 800 degrees C., and then strips of 3 mm in thickness (referred to as "HR pieces" hereinafter) were respectively obtained.

The HR pieces were vacuum-encased in silica tubes and then interiors of the silica tubes were substituted with Ar. They were treated with a solution heat treatment at 950 degrees C. for 2 hours, and subsequently quenched in iced water. Thereby, the titanium alloys of the present examples (referred to as "ST pieces" hereinafter) were obtained. Meanwhile, steps for obtaining the ST pieces from the ingots are shown in FIG. 1.

Working Examples 3, 6, 8, 10, 12, 14, 20, 22

The ST pieces obtained by the working examples 2, 5, 7, 9, 11, 13 were further subject to cold rolling into 1 mm in thickness to provide these titanium alloys of the present examples (referred to as "CR pieces" hereinafter). Meanwhile, steps for obtaining the CR pieces from the ingots are shown in FIG. 1.

Comparative Example 1

Operations similar to the working example 1, except that a V content was 14% and Al was not applied, were repeated to provide the titanium alloy of the present example.

Comparative Example 2

Though operations similar to the working example 1, except that a V content was 12% and an Al content was 18%, had been repeated, hot rolling could not be carried out (resulting cracks) because workability is inferior as the Al content exceeds the range of the present invention.

Comparative Example 3

Operations similar to the working example 1, except that a V content was 25% and an Al content was 4%, were repeated to provide the titanium alloy of the present example.

Comparative Example 4

The ST pieces obtained by the comparative examples 3 was further subject to cold rolling into 1 mm in thickness to provide the titanium alloy of the present example (the CR piece).

Comparative Example 5

Operations similar to the working example 1, except that a V content was 8% and an Al content was 6%, were repeated to provide the titanium alloy of the present example.

EVALUATION METHOD

The following evaluations were carried out with respect to the titanium alloys of the aforementioned examples.

1. Young's Modulus

Young's moduli of the rolling direction were measured by a resonance method in accordance with JIS Z 2280 at the room temperature. The results are shown in Table 1.

2. Study of Composition Phase

Composition phases at the room temperature were studied by using X-ray diffraction and optical microscopic observation. X-ray measurement was carried out with respect to the strips as they were and a Cu tube was used. Peaks were analyzed from the measurement results and thereby composition phases were determined. The results are shown in Table 1. In Table 1, when the α" phase and the α' phase co-exist, existence of the α' phase is indicated with parentheses, as peaks of the α" phase and the α' phase overlap with each other so that the existence of the α' phase cannot be judged.

Further, the composition phases cooled to the liquid nitrogen temperature were studied by an optical microscope. The results are shown in Table 1. Meanwhile, because the α" phase and the α' phase cannot be distinguished in observation under the optical microscope, these phases are referred to as a M phase.

Figure 7:
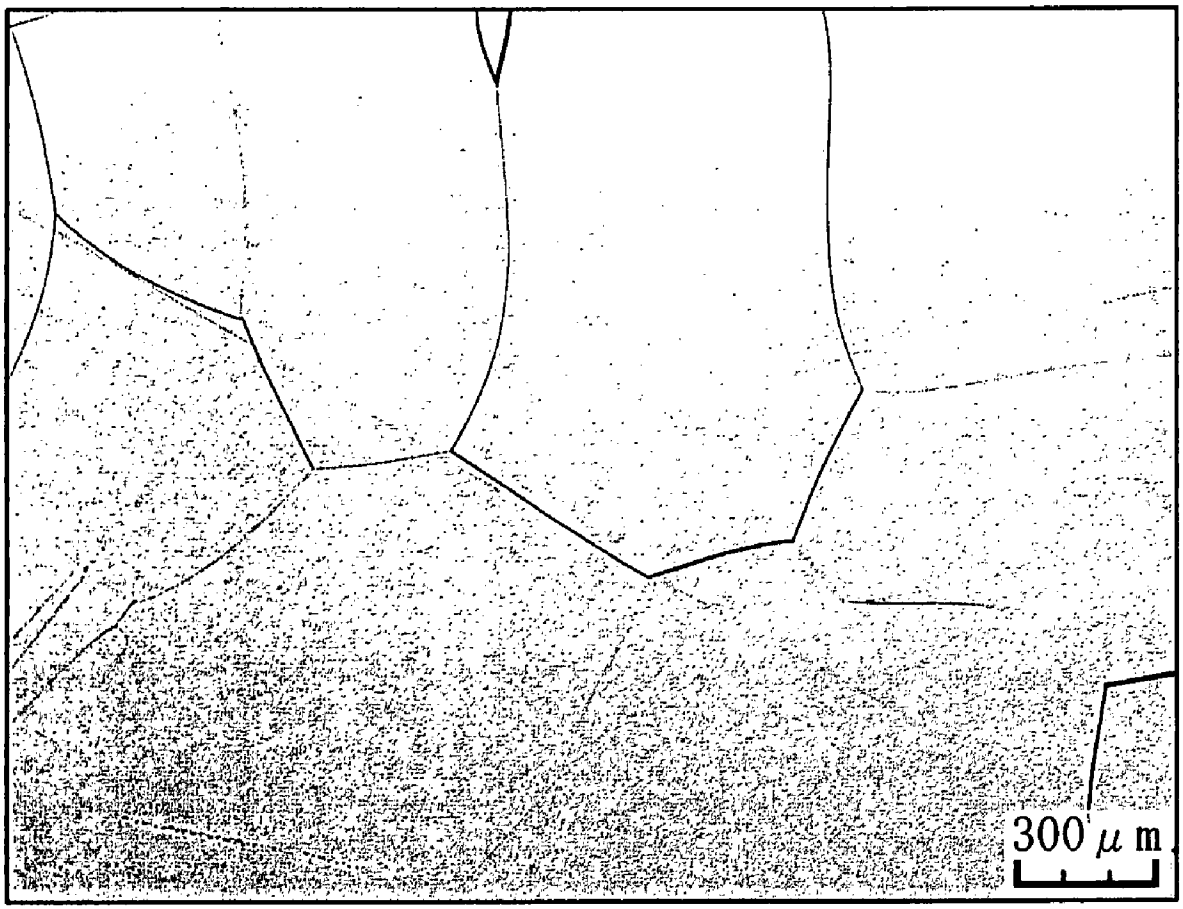
[FIG. 7] is an optical microscopic photograph of a titanium alloy of a working example 13.
Figure 8:
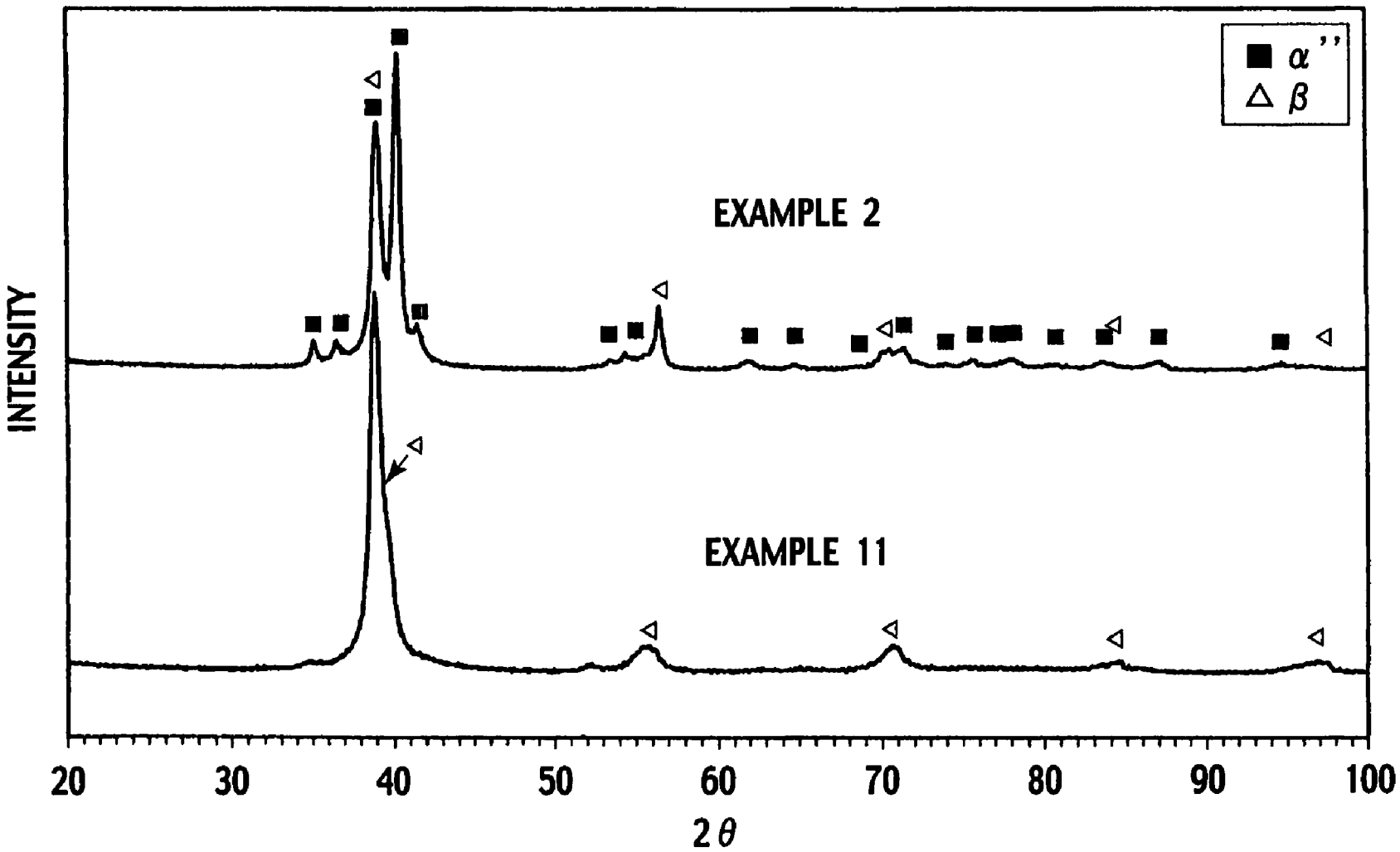
[FIG. 8] is a graph showing X-ray diffraction results of the working example 2 and the working example 11.

Further, with respect to the titanium alloys of the working examples 1, 2, 7, 9, 11, 13, photographs of microstructures taken by the optical microscope are shown in FIG. 2-6. With respect to the titanium alloys of the working examples 2, 11, 13, 14, X-ray diffraction measurement results are shown in FIG. 7 and FIG. 8.

3. Measurement of X-Ray Diffraction Intensities of Sections Perpendicular to and Parallel with a Longitudinal Direction To demonstrate effects of plastic deformation in combination with the titanium alloy according to the embodiments of the present invention, X-ray diffraction measurement was accomplished. X-ray diffraction intensities reflect degrees of alignment of crystal orientations (textures).

Table 2 shows relations between measurement results of X-ray diffraction intensities of longitudinal wire rods and strips in that materials falling in the composition range according to the embodiments of the present invention were treated with thermomechanical treatments in various conditions to change internal textures thereof and Young's moduli. The respective test pieces were treated with wet-grinding and mirror-polishing, each on two sections perpendicular and parallel to the longitudinal direction, and, after preparing surfaces, the X-ray diffraction measurements were carried out.

In these examples, measurement of the X-ray diffraction intensity ratios was carried out with a grazing incident X-ray analyzing apparatus by a wide-angle method. As respective strengths of X-rays, results which were measured with rotating a test piece stage of the X-ray diffraction for homogenizing anisotropy of the test pieces in these measurement surfaces are accepted. Measurement conditions are shown hereinafter.

A X-ray in use: Cu—Kα excitation condition: 45 kV 40 mA range of measurement: 2θ=30-80°

Backgrounds were removed from the measurement results and peak intensity ratios were calculated.

The working example 24 is a wire rod, and the working examples 23, 25 and 26 are strips produced by rolling. Regarding the working examples 23, 25 and 26, these rolling direction are accepted as longitudinal directions, and surfaces of the strips are accepted as sections parallel to the longitudinal directions.

4. Tensile Test

Regarding the titanium alloys of the working examples 1-14, 19-22, and the comparative examples 3-5, yield stresses were measured by a tensile test according to the JIS Z 2241 test. Table 1 shows the results.

From Table 1, the titanium alloys of the working examples as one embodiment of the present invention have Young's moduli of 70 GPa or less, and therefore sufficiently low Young's moduli are obtained.

In particular, comparing the working example 2, in which the V content is lower than 16%, and the working example 11, in which the V content is relatively great (over 16%), the Young's modulus of the working example 11 which has a β phase as a composition phase was further reduced (see FIG. 8).

Further, from the working examples 16-18, sufficiently low Young's moduli were obtained even though the Al contents were relatively small.

It was found that the titanium alloys of the working examples 1-5, 7, 9, 12, 14-22 include the orthorhombic α" phase or the hexagonal α' phase as the composition phase when cooled to the room temperature.

In particular, the titanium alloys of the working examples 1-3 and the working examples 15-18, in which the V contents are 16% or less, included the α" phase or the α' phase to a certain degree.

Figure 9:
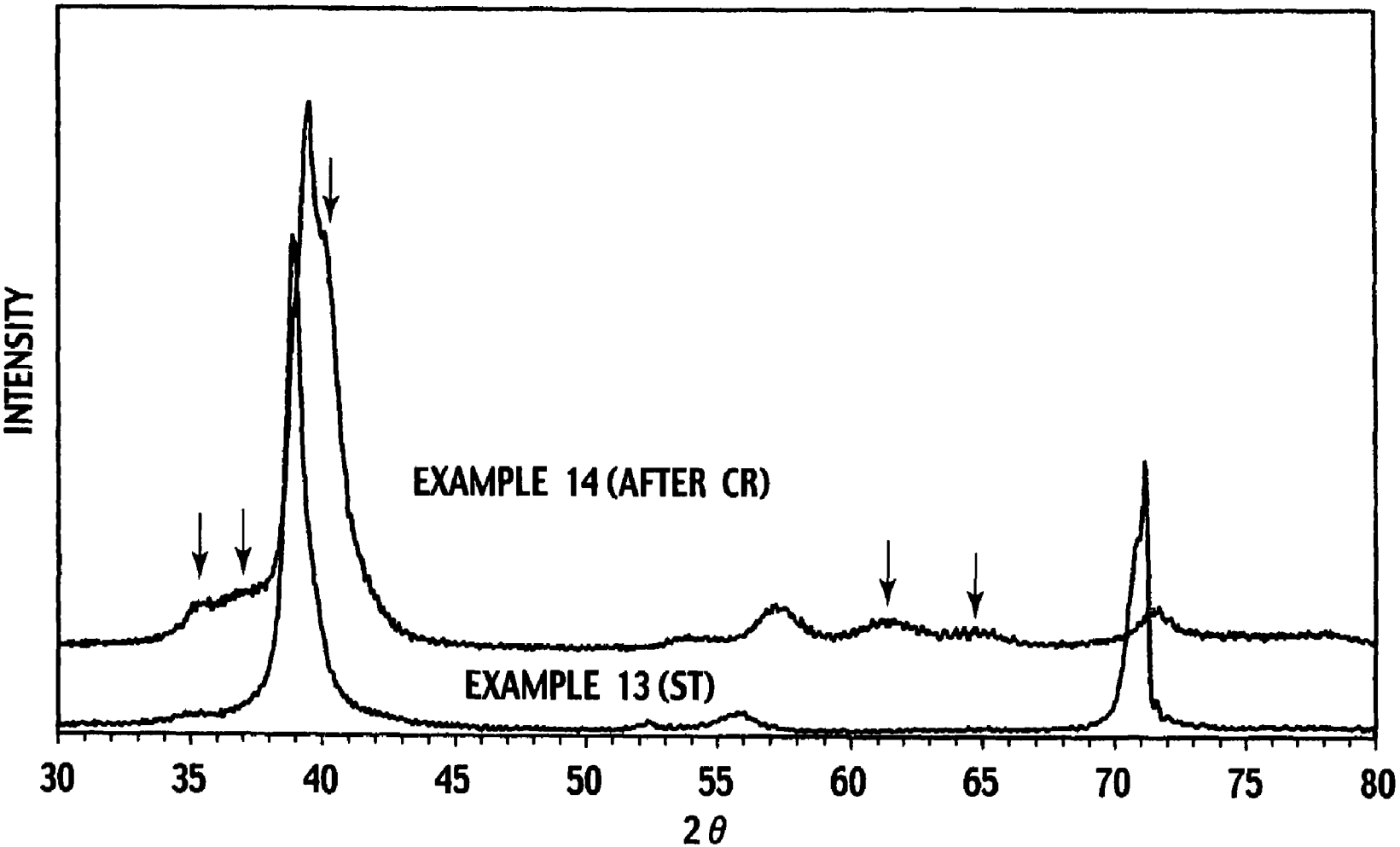
[FIG. 9] is a graph showing X-ray diffraction results of the working example 13 and the working example 14.

Further, the composition phases of the titanium alloys of the working examples 11, 13, in which the V contents are relatively great (more than 16%), were the β phase, however, it was observed that in the titanium alloys of the working examples 12, 14 (CR pieces), in which those of the working examples 11, 13 were subject to cold rolling in a draft ratio of 66%, the martensite phase of the α" phase or the α' phase appeared or increased with respect to the β phase (see FIG. 9). As shown in the graph of FIG. 9, comparing the working example 13 and the working example 14, a peak at a point indicated by an arrow in the graph newly appeared upon

TABLE 1

| | chemical compositions (%), Ti as a balance | | | | Young's modulus | yield strength | composition phase at the room | composition phase at the liquid |
|---|---|---|---|---|---|---|---|---|
| | V | Al | other | treatment | (GPa) | (MPa) | temperature | nitrogen |
| E1 | 11.8 | 2 | | ST | 64.6 | 407 | α' | — |
| E2 | 14.7 | 2 | | ST | 67.7 | 336 | α" + β + (α') | — |
| E3 | 14.7 | 2 | | CR | 54.4 | 935 | α" | — |
| E4 | 13.5 | 10 | | ST | 60.4 | 349 | β + α" + (α') | — |
| E5 | 16.7 | 2 | | ST | 69.9 | 265 | α" + (α') | M |
| E6 | 16.7 | 2 | | CR | 50.4 | 953 | — | — |
| E7 | 17.6 | 2 | | ST | 66 | 229 | β + α" + (α') | — |
| E8 | 17.6 | 2 | | CR | 52.6 | 931 | — | — |
| E9 | 18.6 | 2 | | ST | 64.8 | 250 | β + α" + (α') | — |
| E10 | 18.6 | 2 | | CR | 52 | 912 | — | — |
| E11 | 19.6 | 2 | | ST | 58.2 | 402 | β | β + M |
| E12 | 19.6 | 2 | | CR | 57.9 | 943 | β + α" + (α') | — |
| E13 | 19 | 5 | | ST | 62.6 | 504 | β | β + M |
| E14 | 19 | 5 | | CR | 57 | 828 | β + α" + (α') | — |
| E15 | 14.7 | 2 | Sn: 1% | ST | 64 | — | α" + (α') | — |
| E16 | 12 | 0.2 | Sn: 6% | ST | 60.2 | — | α" + (α') | — |
| E17 | 16 | 0.2 | Si: 1% | ST | 65.5 | — | α" + (α') | — |
| E18 | 14 | 0.2 | In: 3% | ST | 63 | — | α" + (α') | — |
| E19 | 14.4 | 2 | Sn: 2% | ST | 63.6 | 270 | α" | — |
| E20 | 14.4 | 2 | Sn: 2% | CR | 51.9 | 992 | α" | — |
| E21 | 14.4 | 2 | In: 2% | ST | 57.6 | 433 | α" + (α') | — |
| E22 | 14.4 | 2 | In: 2% | CR | 56.6 | 970 | α" + (α') | — |
| C1 | 14 | 0 | | ST | 113.3 | — | β + ω | — |
| C2 | 12 | 18 | | — | — | — | — | — |
| C3 | 25 | 4 | | ST | 73.5 | 555 | β | β |
| C4 | 25 | 4 | | CR | 71.6 | 895 | β | — |
| C5 | 8 | 6 | | ST | 87.9 | 666 | α' | — |

E: working example,
C: comparative example carrying out cold rolling, therefore it was confirmed that a martensite phase by stress induced transformation in the cold rolling newly appeared.

Furthermore, in the titanium alloys of the working examples 11, 13, from optical microscopic observation, it was found that martensite phases are included in the composition phases as martensite structure similar to those shown in FIG. 25 appeared.

Still further, as the working examples 3, 6, 8, 10, 20, 22, if cold rolling is carried out after a solution treatment, Young's moduli in the rolling directions could be further reduced and 0.2% proof stresses thereof were 900 MPa or greater. Therefore, it was confirmed that these alloys have sufficient strengths. As such, the yield strengths are high and elastic deformation can be increased if the Young's modulus is low.

Figure 2:
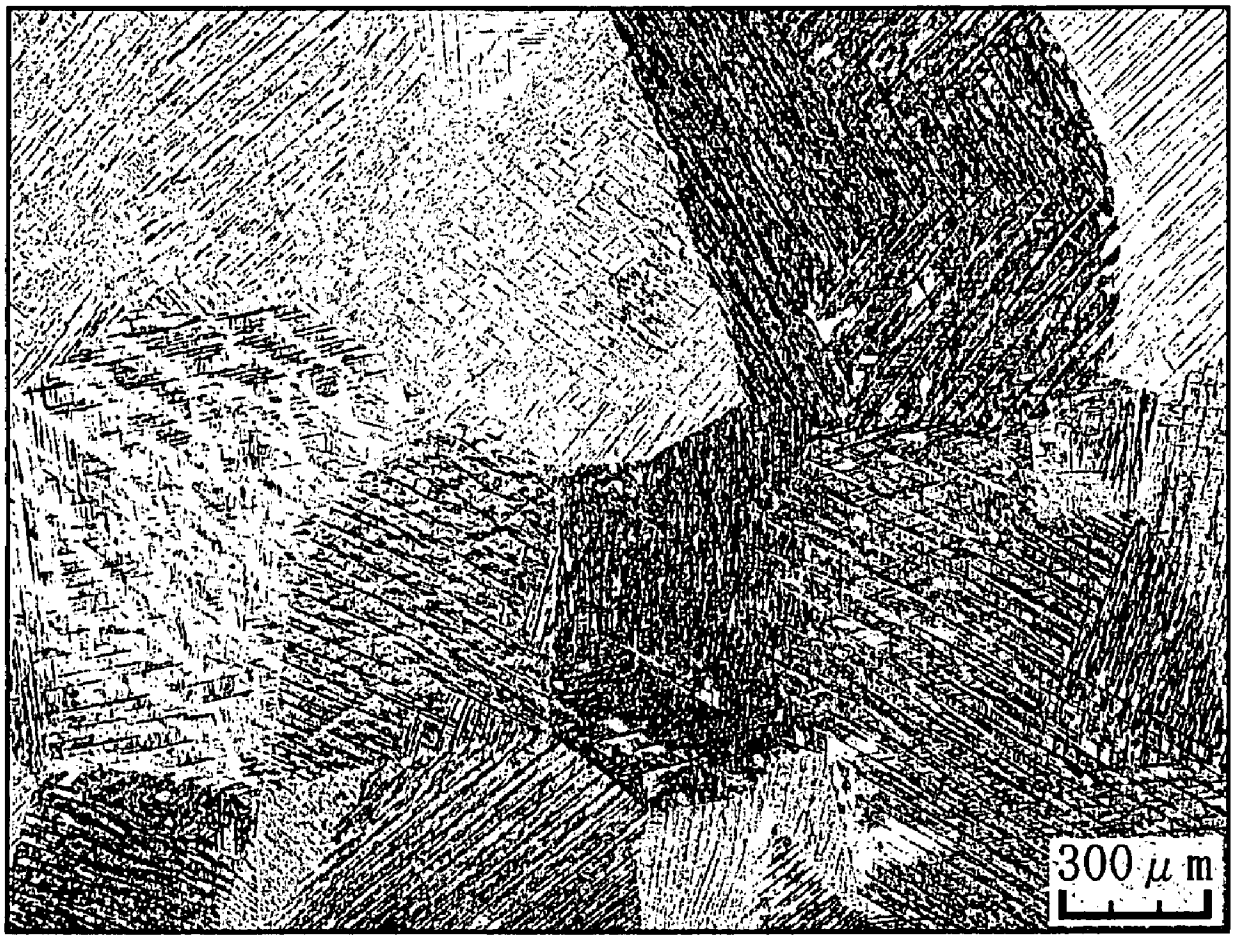
[FIG. 2] is an optical microscopic photograph of a titanium alloy of a working example 1.
Figure 3:
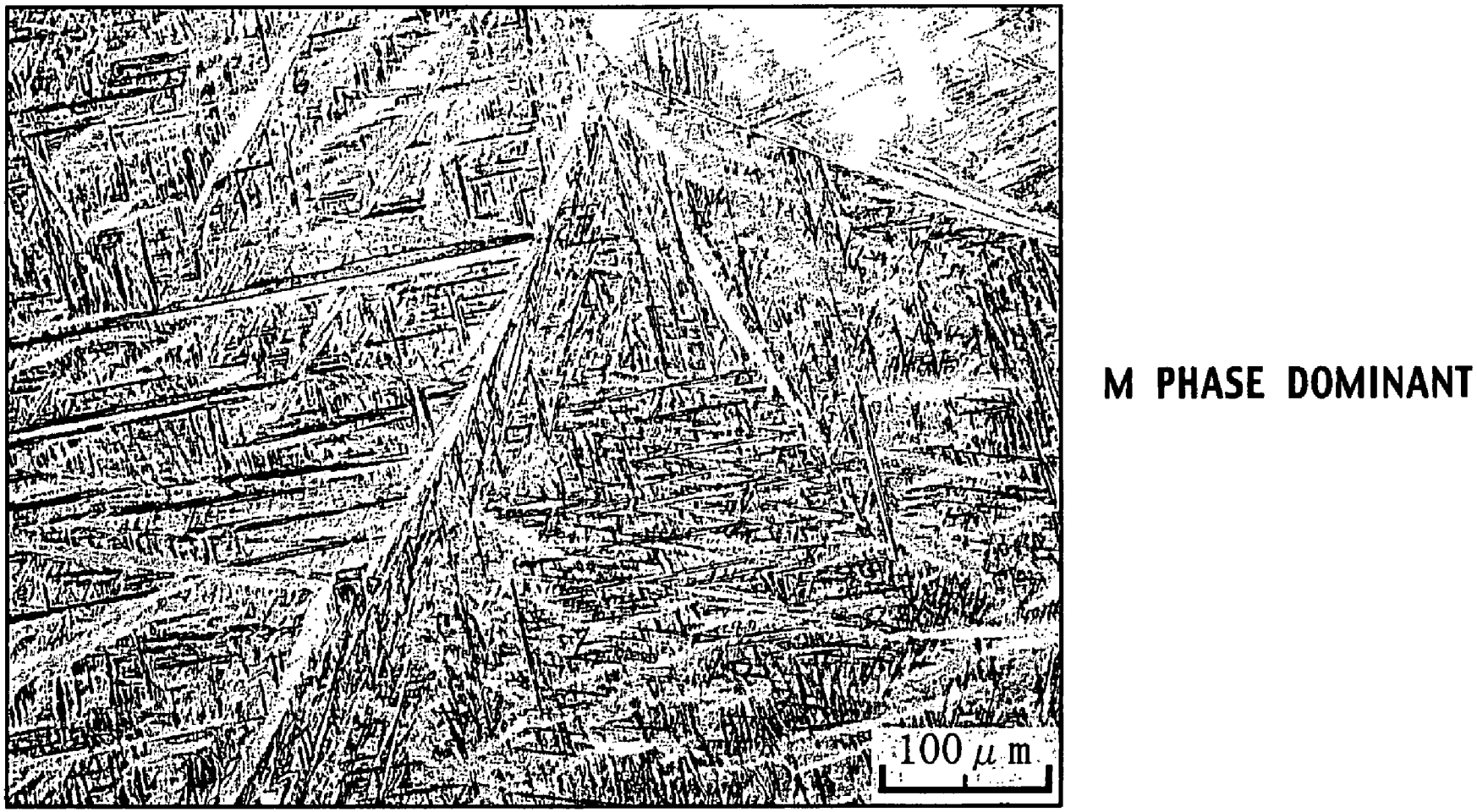
[FIG. 3] is an optical microscopic photograph of a titanium alloy of a working example 2.
Figure 4:
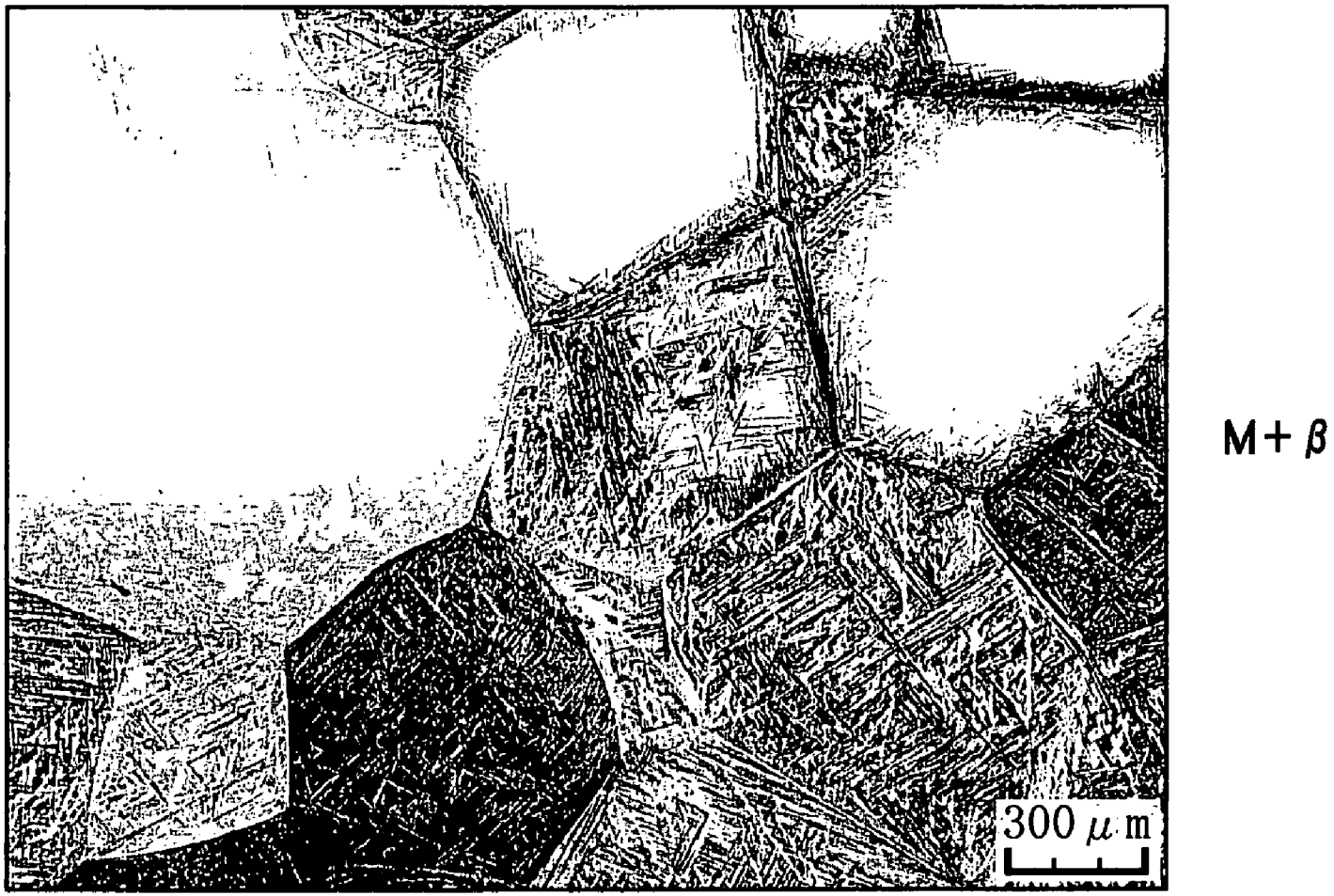
[FIG. 4] is an optical microscopic photograph of a titanium alloy of a working example 7.
Figure 5:
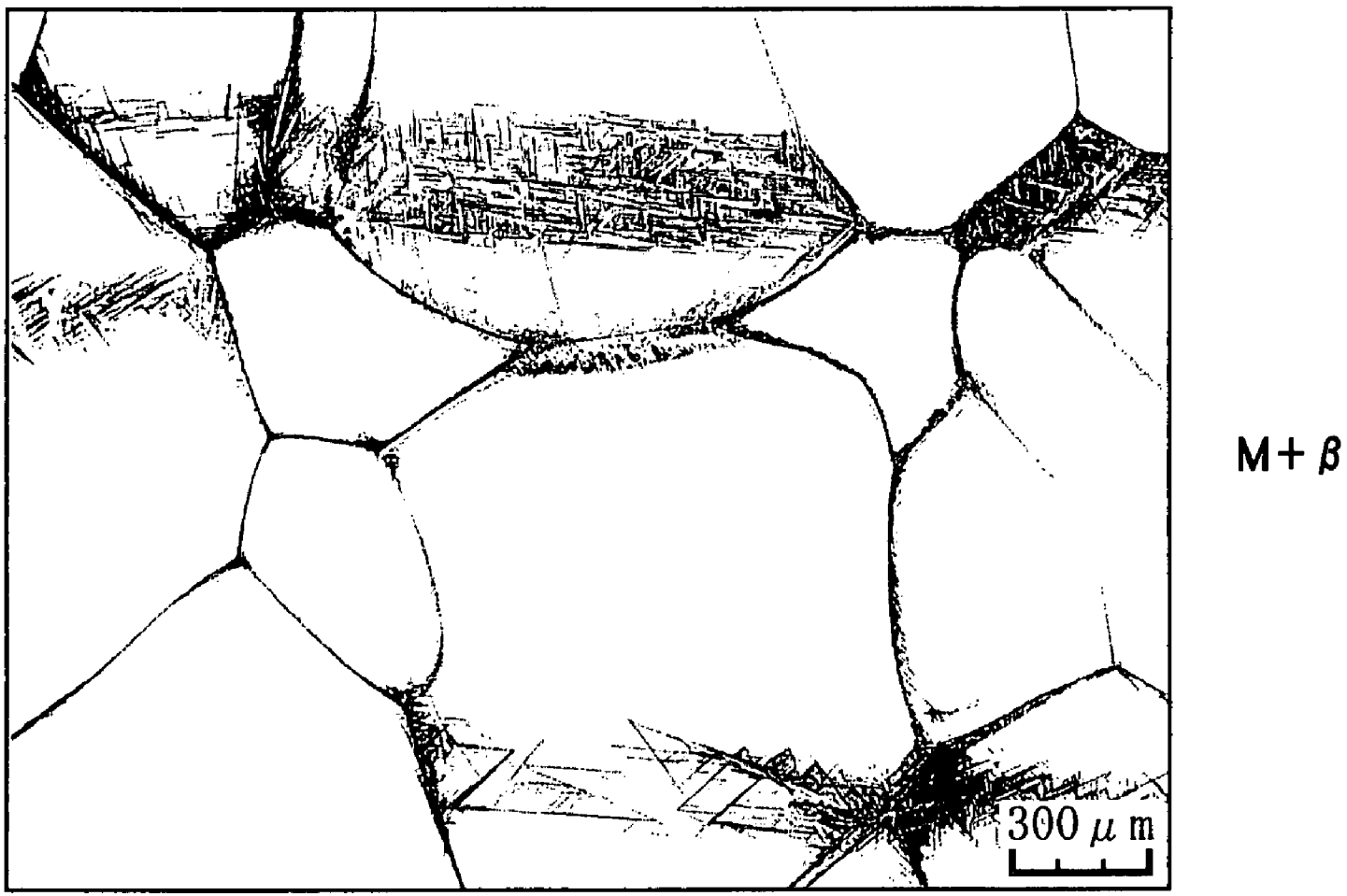
[FIG. 5] is an optical microscopic photograph of a titanium alloy of a working example 9.
Figure 6:
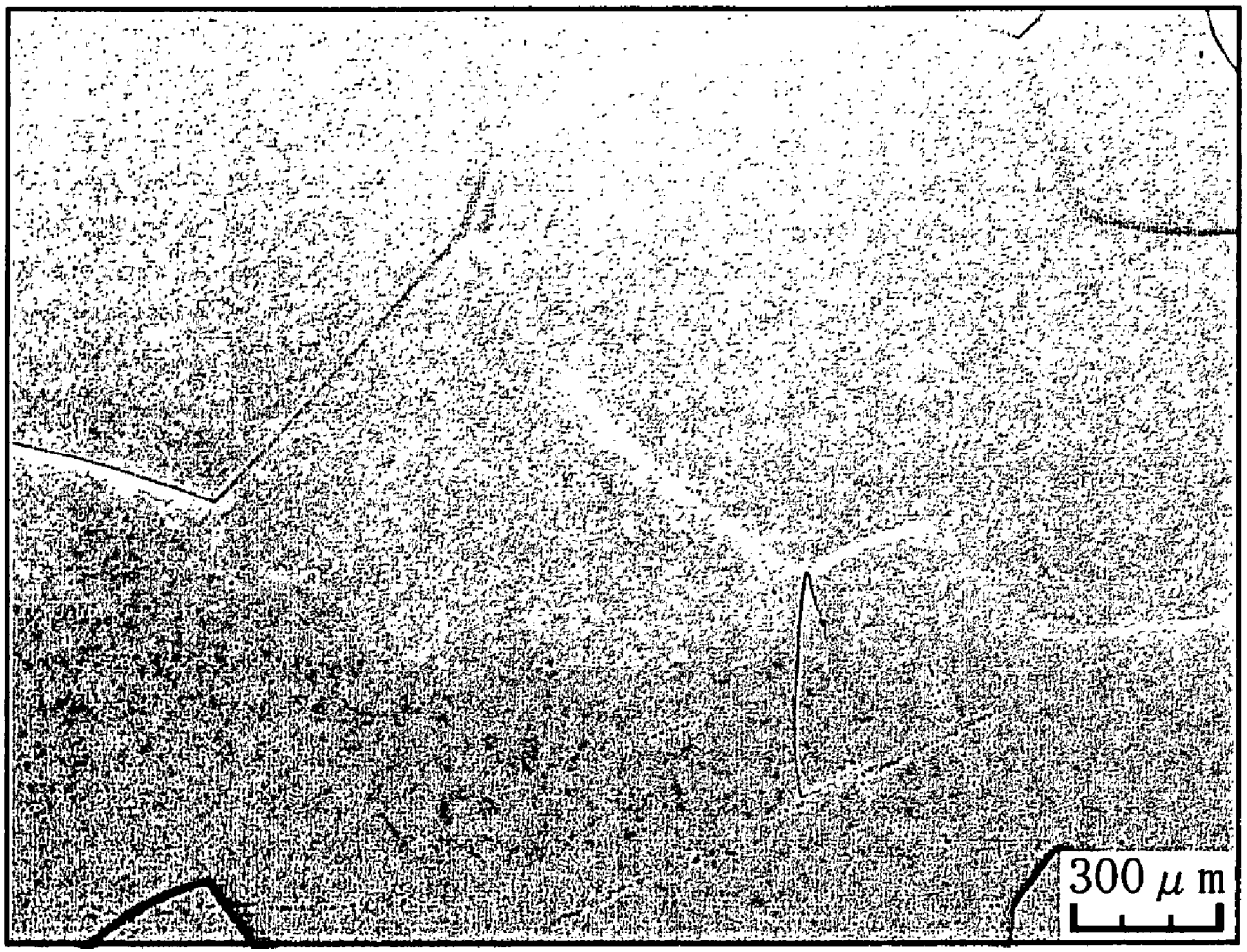
[FIG. 6] is an optical microscopic photograph of a titanium alloy of a working example 11.

Further, as shown in FIG. 2, it was confirmed that the Young's moduli of the working examples 24 and 26 satisfying the equation (1) or the equation (2) can be further reduced as compared with the working examples 23 and 25 respectively having the same chemical compositions as them.

TABLE 2

| | chemical compositions (%), Ti as a balance | | | | | | |
|---|---|---|---|---|---|---|---|
| | V | Al | others | treatment | Young's modulus (GPa) | $\frac{I\alpha'(002)_{\perp}/I\alpha'(101)_{\perp}}{I\alpha'(002)_{\parallel}/I\alpha'(101)_{\parallel}}$ | $\frac{I\alpha''(020)_{\perp}/I\alpha''(111)_{\perp}}{I\alpha''(020)_{\parallel}/I\alpha''(111)_{\parallel}}$ $\frac{I\alpha''(002)_{\perp}/I\alpha''(111)_{\perp}}{I\alpha''(002)_{\parallel}/I\alpha''(111)_{\parallel}}$ |
| E23 | 11.8 | 2 | | The working example 1 was subject to 67% cold rolling and subsequently a solution treatment at 950 degrees C. for 30 min. | 63.8 | 1.24 | — |
| E24 | 11.8 | 2 | | The working example 1 was subject to drawing by 60% in reduction in sectional area. | 57.2 | 0.12 | — |
| E25 | 16.7 | 2 | | The working example 5 was subject to 67% cold rolling and subsequently a solution treatment at 950 degrees C. for 30 min. | 62.0 | — | 1.15 |
| E26 | 16.7 | 2 | | The working example 5 was subject to 67% cold rolling and subsequently cutting out as parallel to the rolling direction to provide a strip (the same as the working example 6 in Table 1). | 50.4 | — | 0.54 |

E: working example

On the other hand, the titanium alloy of the comparative example 1 had a high Young's modulus as a result of appearance of the ω phase after the solution treatment caused by that the alloy does not contain Al suppressing the ω phase at all.

Regarding the comparative example 2, because the Al content exceeds the range regulated in the present invention, workability thereof got worse and therefore cracks occurred in the process of the hot rolling so that production could not be accomplished.

Regarding the titanium alloy of the comparative example 3, because the V content is greater than the range regulated in the present invention, the β phase becomes thermodynamically more stable and the α" phase did not appear even if cooled to the liquid nitrogen temperature, thereby a sufficiently low Young's modulus could not be obtained. Further, it is disadvantageous in view of production cost because the content of V relatively expensive as compared with Ti is greater.

As the comparative example 4, even if cold rolling was carried out for the titanium alloy of the comparative example 3 after a solution treatment, an α" phase did not appear by being induced by stress because the β phase is stable.

Because the titanium alloy of the comparative example 5 has a smaller content of V than the range regulated in the present invention, the Young's modulus exceeds 80 GPa, therefore sufficient elastic deformability could not obtained.

Although the invention has been described above by reference to certain embodiments of the invention, the invention is not limited to the embodiments described above. Modifications and variations of the embodiments described above will occur to those skilled in the art, in light of the above teachings.

What is claimed is:

1. A titanium alloy, comprising:

vanadium, from 10 to 20% by weight;

aluminum, from 0.2 to 10% by weight; and a balance essentially titanium, wherein the alloy is plastically deformed in a specific direction, wherein the deformed alloy has a microstructure including a martensite phase, wherein the martensite phase includes an α' phase and an α" phase, and diffraction intensities of the deformed alloy by an x-ray diffraction method satisfies any one or more inequalities selected from the group of, $$(I\alpha''(002)_{\perp}/I\alpha''(111)_{\perp})/(I\alpha''(002)_{\parallel}/I\alpha''(111)_{\parallel})\leqq 1, \text{ and}$$

$$(I\alpha'(002)_{\perp}/I\alpha'(101)_{\perp})/(I\alpha'(002)_{\parallel}/I\alpha'(101)_{\parallel})\leqq 1,$$

where $I\alpha''(002)_{\perp}$ represents a diffraction intensity from a (002) face of the α" phase in a section perpendicular to the specific direction, $I\alpha''(111)_{\perp}$ represents a diffraction intensity from a (111) face of the α" phase in a section perpendicular to the specific direction, $I\alpha''(002)_{\parallel}$ represents a diffraction intensity from a (002) face of the α" phase in a section parallel to the specific direction, $I\alpha''(111)_{\parallel}$ represents a diffraction intensity from a (111) face of the α" phase in a section parallel to the specific direction, $I\alpha'(002)_{\perp}$ represents a diffraction intensity from a (002) face of the α' phase in a section perpendicular to the specific direction, $I\alpha'(101)_{\perp}$ represents a diffraction intensity from a (101) face of the α' phase in a section perpendicular to the specific direction, $I\alpha'(002)_{\parallel}$ represents a diffraction intensity from a (002) face of the α' phase in a section parallel to the specific direction, and $I\alpha'(101)_{\parallel}$ represents a diffraction intensity from a (101) face of the α' phase in a section parallel to the specific direction.

2. The titanium alloy of claim 1, further comprising:

one or more elements selected from the group of stannum, silicon and indium, the elements being from 0.01 to 10% by weight.

3. The titanium alloy of claim 1, wherein the titanium alloy is treated with a solution treatment at a β transus temperature or higher and cold working after the solution treatment.

4. A titanium alloy having a microstructure, comprising:

vanadium, from 14 to 20% by weight;

aluminum, from 0.2 to 10% by weight; and a balance essentially titanium, wherein the alloy is plastically deformed in a specific direction or is cooled below room temperature, wherein the alloy has a microstructure that includes a martensite phase formed from a β phase via the plastic deformation or the cooling below the room temperature, wherein the martensite phase includes an α' phase and an α" phase, and wherein diffraction intensities of the deformed or cooled alloy by a X-ray diffraction method satisfies any one or more inequalities selected from the group of, $$(I\alpha''(002)_{\perp}/I\alpha''(111)_{\perp})/(I\alpha''(002)_{\parallel}/I\alpha''(111)_{\parallel})\leqq 1, \text{ and}$$

$$(I\alpha'(002)_{\perp}/I\alpha'(101)_{\perp})/(I\alpha'(002)_{\parallel}/I\alpha'(101)_{\parallel})\leqq 1,$$

where $I\alpha''(002)_{\perp}$ represents a diffraction intensity from a (002) face of the α" phase in a section perpendicular to the specific direction, $I\alpha''(111)_{\perp}$ represents a diffraction intensity from a (111) face of the α" phase in a section perpendicular to the specific direction, $I\alpha''(002)_{\parallel}$ represents a diffraction intensity from a (002) face of the α" phase in a section parallel to the specific direction, $I\alpha''(111)_{\parallel}$ represents a diffraction intensity from a (111) face of the α' phase in a section parallel to the specific direction, $I\alpha'(002)_{\perp}$ represents a diffraction intensity from a (002) face of the α' phase in a section perpendicular to the specific direction, $I\alpha'(101)_{\perp}$ represents a diffraction intensity from a (101) face of the α' phase in a section perpendicular to the specific direction, $I\alpha'(002)_{\parallel}$ represents a diffraction intensity from a (002) face of the α' phase in a section parallel to the specific direction, and $I\alpha'(101)_{\parallel}$ represents a diffraction intensity from a (101) face of the α' phase in a section parallel to the specific direction.

5. The titanium alloy of claim 4, further comprising:

one or more elements selected from the group of stannum, silicon and indium, the elements being from 0.01 to 10% by weight.

6. The titanium alloy of claim 4, wherein the titanium alloy is treated with a solution treatment at a β transus temperature or higher and cold working after the solution treatment.

7. The titanium alloy of claim 4, wherein the alloy has a microstructure that includes the martensite phase formed from the β phase via cooling to liquid nitrogen temperature.

* * * * *